US005679508A

United States Patent [19]

Mücke et al.

[11] Patent Number: 5,679,508

[45] Date of Patent: Oct. 21, 1997

[54] COLOR PHOTOGRAPHIC SILVER HALIDE MATERIAL

[75] Inventors: Bruno Mücke, Bergisch Gladbach; Cuong Ly, Köln; Wolfgang Schmidt, Bergisch Gladbach, all of Germany

[73] Assignee: AGFA-Gevaert AG, Leverkusen, Germany

[21] Appl. No.: 605,476

[22] Filed: Feb. 26, 1996

[30] Foreign Application Priority Data

Mar. 7, 1995 [DE] Germany ..... 195 07 914.0

[51] Int. Cl.[6] ..... G03C 1/34

[52] U.S. Cl. ..... 430/611; 430/613; 430/614; 430/567; 430/569

[58] Field of Search ..... 430/614, 611, 430/569, 613, 567

[56] References Cited

U.S. PATENT DOCUMENTS 5,229,264 7/1993 Patzold et al. .

FOREIGN PATENT DOCUMENTS 0 529 811 7/1992 European Pat. Off. .

*Primary Examiner*—Thorl Chea

[57] ABSTRACT

A color photographic silver halide with a support and at least one silver halide emulsion layer, the silver halide of which is stabilized by compounds I and II, is distinguished by reduced storage fog combined with stronger gradation:

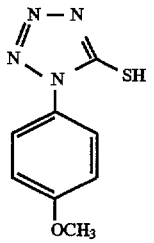

(I)

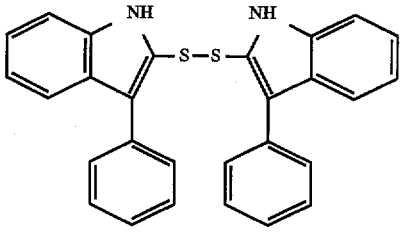

(II)

8 Claims, No Drawings

COLOR PHOTOGRAPHIC SILVER HALIDE MATERIAL

This invention relates to a colour photographic silver halide material with steeper gradation and reduced storage fog.

In order to produce high sensitivity silver halide emulsions, it is necessary to perform chemical ripening with a combination of compounds of gold and sulphur (*Ullmanns Enzyklopäder technischen Chemie,* 4th edition, volume 18, page 424).

Undesirable side effects occurring in these emulsions are a flat threshold and shoulder gradation and elevated fog when fresh.

Furthermore, due to the necessary thorough ripening, a further increase in fog, flattening of gradation and an increase in sensitivity are observed, especially after storage at normal or elevated temperature.

In order to avoid the increase in fog caused by storage at normal or elevated temperature (20° to 60° C.), it is necessary to store the color photographic material, in particular color photographic paper for the production of color prints, at low temperatures from packaging to use. Low temperature storage of the material entails high costs and it is thus frequently omitted or interrupted, which leads to undesirable photographic results.

The object of the invention was thus to provide a photographic material which exhibits no increase in fog on storage at 20° to 60° C. and thus need not be stored at low temperatures.

This object is surprisingly achieved by the combination of two stabilisers, namely 5-mercapto-1-(4-methoxyphenyl) -tetrazole (I) and diphenylindolyl disulphide (II)

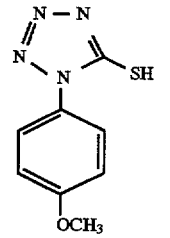

(I)

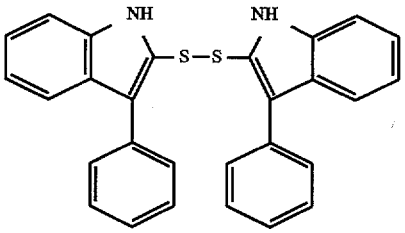

(II)

Both substances have already been used alone or in combination with other stabilisers (EP-529 811, 517 053) without storage fog having consequently been reduced to the desired extent.

It was only once they were used together that they completely surprisingly brought about a reduction in storage fog and a steepening of gradation without reducing sensitivity.

The present invention accordingly provides a color photographic material with a support and at least one silver halide emulsion layer, the silver halide emulsion of which is stabilised with the compounds I and II.

The color photographic material is in particular a copying material, the support of which may be transparent or reflective. Reflective supports, in particular paper coated on both sides with polyethylene, are preferred.

The compound of the formula (I) is added in particular in a quantity of $10^{-7}$ to $10^{-3}$ mol/mol of silver halide of the silver halide emulsion concerned; the compound of the formula (II) is added in particular in a quantity of $10^{-7}$ to $10^{-3}$ mol/mol of silver halide of the silver halide emulsion concerned. Both compounds are added after completion of grain formation, compound I preferably after chemical ripening and compound II preferably before chemical ripening.

The emulsion is preferably ripened with compounds of gold and sulphur, in particular in a concentration of $2\cdot10^{-6}$ to $2\cdot10^{-4}$ mol of gold compound/mol of Ag and $10^{-6}$ to $10^{-4}$ mol of sulphur compound/mol of Ag.

Silver halides which may be considered are AgCl, AgBr, AgBrCl, AgBrI and AgBrClI.

The silver halide emulsion according to the invention preferably has a composition of $AgCl_{0.15}Br_{0.85}$ to $AgCl_{0.999}Br_{0.001}$. Particularly distinct effects are achieved with so-called chloride emulsions, i.e. silver chloride-bromide emulsions with a proportion of chloride of above 80, preferably of above 95 mol. %.

The silver halide emulsion according to the invention is preferably doped with $10^{-9}$ to $10^{-4}$ mol of $Rh^{3+}$ ions and/or $10^{-9}$ to $10^{-4}$ mol of $Ir^{4+}$ ions per mol of silver halide.

Suitable compounds for doping the silver halide emulsion according to the invention are, for example, $Na_3RhCl_6$ and $Na_2IrCl_6$. Further suitable compounds are described in European patents 336 425, 336 426 and 336 427.

Suitable gold ripening agents are, for example, $H(AuCl_4)$ +KSCN, $Na_3[Au(S_2O_3)_2].2H_2O$ and gold rhodanine. Further gold ripening agents are known from German patents 854 883 and 848 910.

Suitable compounds for sulphur ripening are, for example, thiosulphates and thioureas such as N,N-dimethylthiourea and N-allylthiourea together with thioacetamide.

The diindolyl disulphides according to the invention and the production thereof are described in *Chem. Pharm. Bull.* 21 (1973), 2739. The diindolyl disulphides may be added during production of the emulsion. In a preferred embodiment, the compounds according to the invention are added at any desired time after the completion of crystal formation and before the end of chemical ripening. In a particularly preferred embodiment, addition is made directly before the beginning of chemical ripening.

The silver halide crystals may be predominantly compact, being, for example, regularly cubic or octahedral, or they may have transitional shapes. Lamellar crystals may, however, preferably be present, the average ratio of diameter to thickness of which is preferably less than 8:1, wherein the diameter of a grain is defined as the diameter of a circle the contents of which correspond to the projected surface area of the grain. The layers may, however, also have tabular silver halide crystals in which the ratio of diameter to thickness is greater than 8:1.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 μm and 2.0 μm, the grain size distribution may be both homodisperse and heterodisperse. The emulsions may, in addition to the silver halide, also contain organic silver salts, for example silver benzotriazolate or silver behenate.

Two or more types of silver halide emulsions which are produced separately may be used as a mixture.

The photographic emulsions may be produced by various methods (for example P. Glafkides, *Chimie et Physique*

*Photographique*, Paul Montel, Paris (1967), G. F. Duffin, *Photographic Emulsion Chemistry*, The Focal Press, London (1966), V. L. Zelikman et al., *Making and Coating Photographic Emulsion*, The Focal Press, London (1966) from soluble silver salts and soluble halides.

Precipitation of the silver halide preferably proceeds in the presence of the binder, for example gelatine, and may be performed in an acidic, neutral or alkaline pH range, wherein silver halide complexing agents are preferably additionally used. Such agents include, for example, ammonia, thioether, imidazole, ammonium thiocyanate or excess halide. The water-soluble silver salts and the halides are brought together optionally consecutively using the single jet process or simultaneously using the double jet process or by any combination of both processes. Feeding is preferably performed with rising inflow rates, wherein the 'critical' feed rate, at which no further new nuclei are formed, should not be exceeded. The pAg range may vary within wide limits during precipitation, the so-called pAg-controlled process is preferably used in which a specific pAG value is held constant or a defined pAg profile is followed during precipitation. In addition to the preferred precipitation with a halide excess, so-called inverse precipitation with a silver ion excess is, however, also possible. Apart from by precipitation, the silver halide crystals may also grow by physical ripening (Ostwald ripening) in the presence of excess halide and/or silver halide complexing agent. Growth of the emulsion grains may even predominantly proceed by Ostwald ripening, wherein preferably a fine grained, so-called Lippmann emulsion is mixed with a more sparingly soluble emulsion and recrystallised onto it.

Salts or complexes of metals such as Cd, Zn, Pb, Tl, Bi, Fe may also be present during precipitation and/or physical ripening of the silver halide grains.

Precipitation may furthermore also proceed in the presence of sensitising dyes. Complexing agents and/or dyes may be made ineffective at any desired point in time, for example by altering the pH value or by oxidative treatment.

Gelatine is preferably used as the binder. Gelatine may, however, be entirely or partially replaced with other synthetic, semi-synthetic or also naturally occurring polymers. Synthetic gelatine substitutes are, for example, polyvinyl alcohol, poly-N-vinylpyrrolidone, polyacrylamides, polyacrylic acid and the derivatives thereof, in particular the copolymers thereof. Naturally occurring gelatine substitutes are, for example, other proteins such as albumin or casein, cellulose, sugar, starch or alginates. Semi-synthetic gelatine substitutes are usually modified natural products. Cellulose derivatives such as hydroxyalkylcellulose, carboxymethylcellulose and phthalylcellulose together with gelatine derivatives obtained by reaction with alkylating or acylating agents or by grafting polymerisable monomers, are examples of such substances.

The binders should have a sufficient quantity of functional groups available so that satisfactorily resistant layers may be produced by reaction with suitable hardeners. Such functional groups are in particular amino groups, but also carboxyl groups, hydroxyl groups and active methylene groups.

The preferably used gelatine may be obtained by acid or alkaline digestion. The gelatine may be oxidised. The production of such gelatines is described, for example, in *The Science and Technology of Gelatine*, edited by A. G. Ward and A. Courts, Academic Press 1977, pages 295 et seq. The gelatine used in each case should have a content of photographically active impurities which is as low as possible (inert gelatine). Gelatines with high viscosity and low swelling are particularly advantageous.

On completion of crystal formation, or also at an earlier point in time, the soluble salts are eliminated from the emulsion, for example by noodling and washing, by flocculation and washing, by ultrafiltration or by ion exchangers.

The photographic emulsions may contain compounds to prevent fogging or to stabilise photographic function during production, storage or photographic processing.

Azaindenes are particularly suitable, preferably tetra- and pentaazaindenes, particularly those substituted with hydroxyl or amino groups. Such compounds have been described, for example, by Birr, *Z. Wiss. Phot.*, 47, (1952), pages 2–58. Furthermore, salts of metals such as mercury or cadmium, aromatic sulphonic or sulphinic acids such as benzenesulphinic acid, or heterocyclics containing nitrogen such as nitrobenzimidazole, nitroindazole, (substituted) benzotriazoles or benzothiazolium salts may also be used as anti-fogging agents. Particularly suitable compounds are heterocyclics containing mercapto groups, for example mercaptobenzothiazoles, mercaptobenzimidazoles, mercaptotetrazoles, mercaptothiazoles, mercaptopyrimidines, wherein these mercaptoazoles may also contain a water solubilising group, for example a carboxyl group or sulpho group. Further suitable compounds are disclosed in *Research Disclosure* no. 17643 (1978), section VI.

The stabilisers may be added to the silver halide emulsions before, during or after the ripening thereof. The compounds may, of course, also be added to other photographic layers which are associated with a silver halide layer.

Mixtures of two or more of the stated compounds may also be used.

The photographic emulsion layers or other hydrophilic colloidal layers of the photosensitive material produced according to the invention may contain surface-active agents for various purposes, such as coating auxiliaries, to prevent formation of electric charges, to improve sliding properties, to emulsify the dispersion, to prevent adhesion and to improve photographic characteristics (for example acceleration of development, high contrast, sensitisation etc.).

The photographic emulsions may be spectrally sensitised by using methine dyes or other dyes. Particularly suitable dyes are cyanine dyes, merocyanine dyes and complex merocyanine dyes.

Sensitisers may be dispensed with if the intrinsic sensitivity of a silver halide is sufficient for a particular spectral range, for example the blue sensitivity of silver bromide.

Suitable supports for the production of color photographic materials are, for example, films and sheets of semi-synthetic and synthetic polymers, such as cellulose nitrate, cellulose acetate, cellulose butyrate, polystyrene, polyvinyl chloride, polyethylene terephthalate and polycarbonate and paper laminated with a barytes layer or an α-olefin polymer layer (for example polyethylene). These supports may be colored with dyes and pigments, for example titanium dioxide. They may also be colored black in order to provide light shielding. The surface of the support is generally subjected to a treatment in order to improve the adhesion of the photographic emulsion layer, for example to a corona discharge with subsequent application of a substrate layer.

The color photographic materials conventionally contain at least one red-sensitive, one green-sensitive and one blue-sensitive silver halide emulsion layer. These emulsion layers are associated with non-diffusing monomeric or polymeric color couplers which may be located in the same layer or in an adjacent layer. Usually, cyan couplers are associated with the red-sensitive layers, magenta couplers with the green-sensitive layers and yellow couplers with the blue-sensitive layers.

Color couplers to produce the cyan partial color image are generally couplers of the phenol or α-naphthol type; suitable examples of such couplers are known from the literature.

Color couplers to produce the yellow partial color image are generally couplers with an open-chain ketomethylene grouping, in particular couplers of the α-acylacetamide type; suitable examples of these are α-benzoylacetanilide and α-pivaloylacetanilide couplers, which are also known from the literature.

Colour couplers to produce the magenta partial color image are generally couplers of the 5-pyrazolone, indazolone or pyrazoloazole type; suitable examples of these couplers are described in great numbers in the literature.

The color couplers may be 4-equivalent couplers, but they may also be 2-equivalent couplers. The latter are differentiated from 4-equivalent couplers by containing a substituent at the coupling site which is eliminated on coupling. 2-equivalent couplers are considered to be those which are colourless, as well as those which have an intense intrinsic color which on color coupling disappears or is replaced by the color of the image dye produced (masking couplers), and white couplers which, on reaction with color developer oxidation products, give rise to substantially colorless products. 2-equivalent couplers are further considered to be those which contain an eliminable residue at the coupling site, which residue is liberated on reaction with color developer oxidation products and so either directly or after one or more further groups are eliminated from the initially eliminated residue (for example, DE-A-2 703 145, DE-A-2 855 697, DE-A-3 05 026, DE-A-3 319 428), produces a specific desired photographic effect, for example as a development inhibitor or accelerator. Examples of such 2-equivalent couplers are the known DIR couplers as well as DAR or FAR couplers.

Since with the DIR, DAR or FAR couplers it is mainly the activity of the residue released on coupling that is desired and the chromogenic properties of these couplers are of lesser importance, those DIR, DAR or FAR couplers which give rise to substantially colorless products on coupling are also suitable (DE-A-1 547 640).

The eliminable residue may also be a ballast residue such that, on reaction with color developer oxidation products, coupling products are obtained which are diffusible or have at least weak or restricted mobility (U.S. Pat. No. 4,420, 556).

High molecular weight color couplers are described, for example, in DE-C-1 297 417, DE-A-2 407 569, DE-A-3 148 125, DE-A-3 217 200, DE-A-3 320 079, DE-A-3 324 932, DE-A-3 331 743, DE-A-3 340 376, EP-A-27 284, U.S. Pat. No. 4,080,211. The high molecular weight color couplers are generally produced by polymerisation of ethylenically unsaturated monomeric color couplers. They may, however, also be obtained by polyaddition or polycondensation.

The incorporation of couplers or other compounds into silver halide emulsion layers may proceed by initially producing a solution, dispersion or emulsion of the compound concerned and then adding it to the casting solution for the layer concerned. Selection of the appropriate solvent or dispersant depends on the particular solubility of the compound.

Methods for the introduction of compounds which are essentially insoluble in water by a grinding process are described, for example, in DE-A-2 609 741 and DE-A-2 609 742.

Hydrophobic compounds may also be introduced into the casting solution by using high-boiling solvents, so-called oil formers. Corresponding methods are described, for example, in U.S. Pat. No. 2,322,027, U.S. Pat. No. 2,801,170, U.S. Pat. No. 2,801,171 and EP-A-0 043 037.

Oligomers or polymers, so-called polymeric oil formers, may be used instead of high-boiling solvents.

The compounds may also be introduced into the casting solution in the form of filled latices. Reference is, for example, made to DE-A-2 541 230, DE-A-2 541 274, DE-A-2 835 856, EP-A-0 014 921, EP-A-0 069 671, EP-A-0 130 115, U.S. Pat. No. 4,291,113.

The non-diffusible inclusion of anionic water-soluble compounds (for example of dyes) may also proceed with the assistance of cationic polymers, so-called mordanting polymers.

Suitable oil formers are, for example, phthalic acid alkyl esters, phosphoric acid esters, citric acid esters, benzoic acid esters, alkylamides, fatty acid esters and trimesic acid esters.

The non photosensitive interlayers generally located between layers of different spectral sensitivity may contain agents which prevent an undesirable diffusion of developer oxidation products from one photosensitive layer into another photosensitive layer with a different spectral sensitisation.

If there are two or more partial layers of the same spectral sensitisation, then they may differ in composition, particularly in terms of the type and quantity of silver halide grains. In general, the partial layer with the greater sensitivity will be located further from the support than the partial layer with lower sensitivity. Partial layers of the same spectral sensitisation may be adjacent to each other or may be separated by other layers, for example layers of different spectral sensitisation. Thus, for example, all high sensitivity and all low sensitivity layers may be grouped together each in a package of layers (DE-A-1 958 709, DE-A-2 530 645, DE-A-2 622 922).

The photographic material may also contain UV light absorbing compounds, optical whiteners, spacers, filter dyes, formalin scavengers and others.

UV light absorbing compounds are intended on the one hand to protect the colour dyes from bleaching by high-UV daylight and on the other hand to absorb the UV light in daylight on exposure and so improve the colour reproduction of a film. Conventionally, compounds of different structure are used for the two tasks. Examples are aryl-substituted benzotriazole compounds (U.S. Pat. No. 3,533, 794), 4-thiazolidone compounds (U.S. Pat. No. 3,314,794 and 3,352,681), benzophenone compounds (JP-A-2784/71), cinnamic acid ester compounds (U.S. Pat. No. 3,705,805 and 3,707,375), butadiene compounds (U.S. Pat. No. 4,015,229) or benzoxazole compounds (U.S. Pat. No. 3,700,455).

Ultra-violet absorbing couplers (such as cyan couplers of the α-naphthol type) and ultra-violet absorbing polymers may also be used. These ultra-violet absorbents may be fixed into a special layer by mordanting.

Filter dyes suitable for visible light include oxonol dyes, hemioxonol dyes, styrene dyes, merocyanine dyes, cyanine dyes and azo dyes. Of these dyes, oxonol dyes, hemioxonol dyes and merocyanine dyes are particularly advantageously used.

Suitable optical whiteners are, for example, described in *Research Disclosure* December 1978, pages 22 et seq., report 17 643, section V.

Certain binder layers, in particular the layer furthest away from the support, but also occasionally interlayers, particularly if they constitute the layer furthest away from the support during manufacture, may contain photographically inert particles of an inorganic or organic nature, for example as flatting agents or spacers (DE-A-3 331 542, DE-A-3 424 893, *Research Disclosure* December 1978, pages 22 et seq., report 17643, section XVI).

The average particle diameter of the spacers is in particular in the range from 0.2 to 10 μm. The spacers are insoluble in water and may be soluble or insoluble in alkali, wherein alkali-soluble spacers are generally removed from the photographic material in the alkaline developing bath. Examples of suitable polymers are polymethyl methacrylate, copolymers of acrylic acid and methyl methacrylate together with hydroxypropylmethylcellulose hexahydrophthalate.

The binders of the material according to the invention, particularly when gelatine is used as the binder, are hardened with suitable hardeners, for example with epoxy, ethylenium, acryloyl or vinyl sulphone type hardeners. Hardeners of the diazine, triazine or 1,2-dihydroquinoline series are also suitable.

The binders of the material according to the invention are preferably hardened with instant hardeners.

Instant hardeners are taken to be compounds which harden suitable binders in such a way that immediately after casting, at the latest after 24 hours, preferably at the latest after 8 hours, hardening is concluded to such an extent that there is no further alteration in the sensitometry and swelling of the layered structure determined by the crosslinking reaction. Swelling is taken to be the difference between the wet layer thickness and the dry layer thickness during aqueous processing of the film (*Photogr. Sci. Eng.* 8 (1964), 275; *Photogr. Sci. Eng.* (1972), 449).

These hardeners which react very rapidly with gelatine are, for example, carbamoylpyridinium salts, which are capable of reacting with the free carboxyl groups of the gelatine, so that the latter react with free amino groups of the gelatine to form peptide bonds crosslinking the gelatine.

Suitable examples of instant hardeners are described, for example, in European Patent 313 949.

The materials according to the invention are processed in the conventional manner using the processes recommended for them.

EXAMPLE 1

The following solutions are prepared using demineralised water in each case:

| | | |
|---|---|---|
| Solution 1: | 7000 ml | water |
| | 540 g | gelatine |
| Solution 2: | 7000 ml | water |
| | 1300 g | NaCl |
| | 21.5 g | KBr |
| | $5 \cdot 10^{-5}$ g | $K_2IrCl_6$ |
| | $3 \cdot 10^{-5}$ g | $Na_3RhCl_6$ |
| Solution 3: | 7000 ml | water |
| | 3000 g | $AgNO_3$ |

Solutions 2 and 3 are simultaneously added to solution 1 at 50° C. and a pAg of 7.7 over the course of 120 minutes with vigorous stirring. A silver chloride emulsion with an average particle diameter of 0.8 μm is obtained. The gelatine:$AgNO_3$ weight ratio is 0.18. The emulsion is flocculated, washed and redispersed with a quantity of gelatine in a known manner, such that the gelatine:$AgNO_3$ weight ratio is 1.0. The emulsion contains 1 mol of silver halide per kg. The emulsion is then optimally ripened at a pH of 4.5 with 3.5 μmol of gold chloride/mol of Ag and 1.50 μmol of $Na_2S_2O_3$/mol of Ag. After chemical ripening, the emulsion (silver halide composition: $AgCl_{0.99}Br_{0.01}$) is stabilised with 87 mg of 1-phenyl-5-mercaptotetrazole/mol of silver halide and sensitised for the blue range of the spectrum.

The emulsion is then combined with a solution of the yellow coupler of the formula

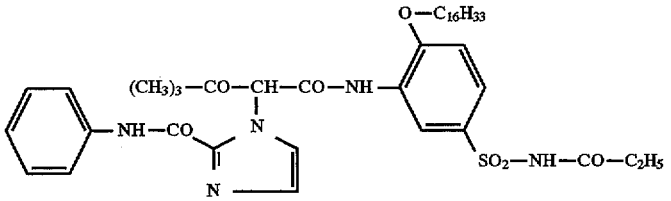

and the white coupler of the formula

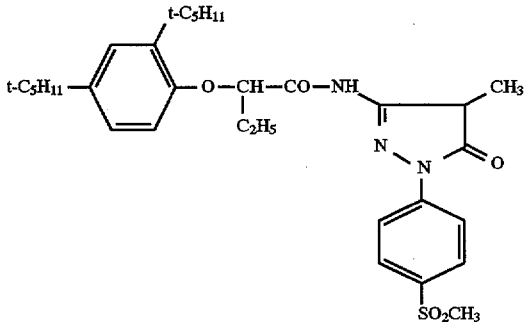

in tricresyl phosphate and applied onto a film support of paper coated on both sides with polyethylene.

Each $m^2$ of the layer contains:

0.63 g of $AgNO_3$ 1.38 g of gelatine 0.95 g of yellow coupler 0.2 g of white coupler 0.29 g of tricresyl phosphate.

A protective layer of 0.2 g of gelatine and 0.3 g of hardener of the formula

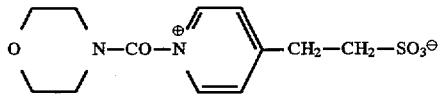

is cast over each $m^2$ of this layer. The material is exposed with an image and processed using the Ektacolor RA 4 process.

EXAMPLES 2–5

The emulsion is produced and processed as described in example 1, but with the difference that compounds (I) and/or (II) are added instead of 1-phenyl-5-mercapto-tetrazole, wherein (I) is added after and (II) before the addition of thiosulphate.

The quantities of compounds (I) and (II) and the sensitometric results are shown in tables 1 to 3.

Table 1 shows the sensitometric data when fresh. Table 2 shows the changes in the sensitometric data after 6 months' storage at 20° C.

Table 3 shows the change in the sensitometric data after 10 days' storage at 54° C. During this test, the material was packed in material which was largely impermeable to gas and moisture.

TABLE 1

| Test | Compound I mg/mol of $AgNO_3$ | Compound II mg/mol of $AgNO_3$ | $D_{min}$ | lg I · t | G1 | G2 |
|---|---|---|---|---|---|---|
| 1 | 0 | 0 | 0.111 | 2.095 | 1.64 | 2.81 |
| 2 | 0 | 5.9 | 0.105 | 2.063 | 1.85 | 3.69 |
| 3 | 78.2 | 0 | 0.103 | 2.068 | 1.79 | 3.21 |
| 4 | 78.2 | 5.9 | 0.098 | 1.997 | 1.90 | 4.20 |
| 5 | 104.3 | 13.5 | 0.096 | 1.981 | 2.12 | 4.45 |

$D_{min}$ fog after 1 day
lg I · t sensitivity
G1 threshold gradation
G2 shoulder gradation

TABLE 2

| Test | $\Delta D_{min}$ | Δlg I · t | ΔG1 | ΔG2 |
|---|---|---|---|---|
| 1 | 0.045 | 0.35 | −0.48 | −0.62 |
| 2 | 0.023 | 0.15 | −0.23 | −0.48 |
| 3 | 0.019 | 0.22 | −0.29 | −0.42 |
| 4 | 0.008 | 0.06 | −0.10 | −0.19 |
| 5 | 0.003 | 0.04 | −0.07 | −0.03 |

$\Delta D_{min}$ fog after 6 months' storage at 20° C. minus fog after 1 day
Δlg I · t reduction in sensitivity after 6 months' storage at 20° C.
ΔG1 flattening of threshold gradation after 6 months' storage at 20° C.
ΔG2 flattening of shoulder gradation after 6 months' storage at 20° C.

TABLE 3

| Test | $\Delta D_{min}$* | Δlg I · t* | ΔG1* | ΔG2* |
|---|---|---|---|---|
| 1 | 0.071 | 0.43 | −0.51 | −0.73 |
| 2 | 0.043 | 0.21 | −0.35 | −0.54 |
| 3 | 0.035 | 0.27 | −0.22 | −0.43 |
| 4 | 0.015 | 0.15 | −0.16 | −0.21 |
| 5 | 0.007 | 0.08 | −0.07 | −0.08 |

$\Delta D_{min}$* fog after 10 days' storage at 54° C. minus fog after 1 day (fresh)
Δlg I · t* reduction in sensitivity after 10 days' storage at 54° C.
ΔG1* flattening of threshold gradation after 10 days' storage at 54° C.
ΔG2* flattening of shoulder gradation after 10 days' storage at 54° C.

Tests 4 and 5 according to the invention demonstrate that compounds I and II bring about a synergistic effect.

EXAMPLES 6 to 13

The emulsions are produced and processed as in example 1, wherein compounds I and II were added individually to the emulsion in varying concentrations instead of 1-phenyl-5-mercaptotetrazole. Compound I was added after completion of chemical ripening, compound II was added before the thiosulphate at the beginning of chemical ripening.

Table 4 shows the sensitometric data when fresh. Table 5 shows the change in sensitometric data after 6 months' storage at 20° C.

TABLE 4

| Test | Compound I mg/mol of $AgNO_3$ | Compound II mg/mol of $AgNO_3$ | $D_{min}$ | lg I · t | G1 | G2 |
|---|---|---|---|---|---|---|
| 6 | 50 | 0 | 0.108 | 2.085 | 1.84 | 3.10 |
| 7 | 90 | 0 | 0.102 | 2.066 | 1.95 | 3.25 |
| 8 | 130 | 0 | 0.099 | 1.910 | 2.05 | 3.39 |
| 9 | 170 | 0 | 0.096 | 1.821 | 2.21 | 3.68 |
| 10 | 0 | 15 | 0.104 | 2.038 | 1.90 | 3.75 |
| 11 | 0 | 25 | 0.102 | 2.002 | 1.93 | 3.83 |
| 12 | 0 | 35 | 0.098 | 1.980 | 1.96 | 3.89 |
| 13 | 0 | 45 | 0.097 | 1.967 | 1.98 | 3.94 |

TABLE 5

| Test | $\Delta D_{min}$ | Δlg I · t | ΔG1 | ΔG2 |
|---|---|---|---|---|
| 6 | 0.025 | 0.29 | −0.35 | −0.51 |
| 7 | 0.017 | 0.19 | −0.21 | −0.42 |
| 8 | 0.015 | 0.15 | −0.20 | −0.38 |
| 9 | 0.014 | 0.13 | −0.18 | −0.35 |
| 10 | 0.021 | 0.14 | −0.22 | −0.43 |
| 11 | 0.019 | 0.12 | −0.21 | −0.38 |
| 12 | 0.019 | 0.12 | −0.19 | −0.35 |
| 13 | 0.018 | 0.11 | −0.18 | −0.34 |

It is clear from table 5 that, even when added in increased quantities, neither of compounds I and II alone achieves equally good storage stability as when both are added simultaneously.

EXAMPLES 14

A colour photographic recording material was produced by applying the following layers in the stated sequence onto a film support of paper coated on both sides with polyethylene. The stated quantities relate in each case to 1 $m^2$. The corresponding quantities of $AgNO_3$ are stated for the quantity of silver halide applied.

Layer structure 1

1st layer (substrate layer): 0.3 g of gelatine

2nd layer (blue-sensitive layer):

Blue-sensitive silver halide emulsion according to example 1 prepared from 0.63 g of $AgNO_3$ with 1.38 g of gelatine 0.95 g of yellow coupler according to example 1

0.29 g of tricresyl phosphate (TCP)

3rd layer (interlayer):

1.1 g of gelatine 0.06 g of 2,5-dioctylhydroquinone 0.06 g of dibutyl phthalate (DBP)

4th layer (green-sensitive layer):

Green-sensitised silver halide emulsion (99.5 mol. % AgCl, 0.5 mol. % AgBr, average grain diameter 0.4 μm, doped with $1\times10^{-7}$ mol of $K_4IrCl_6$/mol of silver halide) prepared from 0.45 g of $AgNO_3$ with 1.08 g of gelatine 0.45 g of magenta coupler (see formula below)

0.08 g of 2,5-dioctylhydroquinone 0.5 g of DBP 0.4 g of TCP

5th layer (UV protective layer):

1.15 g of gelatine 0.6 g of UV absorber of the formula

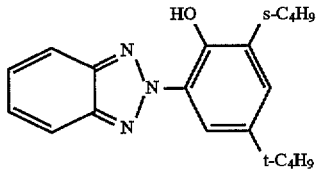

0.045 g of 2,5-dioctylhydroquinone 0.3 g of TCP

6th layer (red-sensitive layer):

Red-sensitised silver halide emulsion (99.5 mol. % AgCl, 0.5 mol. % AgBr, average grain diameter 0.4 μm, doped with $1\times10^{-7}$ mol of $K_4IrCl_6$/mol of silver halide) prepared from 0.3 g of $AgNO_3$ with 0.75 g of gelatine 0.36 g of cyan coupler (see formula below)

0.36 g of TCP

7th layer (UV protective layer):

0.35 g of gelatine 0.15 g of UV absorber as in 5th layer 0.075 g of TCP

8th layer (protective layer):

0.9 g of gelatine 0.3 g of hardener of the formula

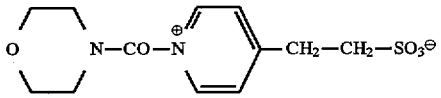

Layer structure 2

As layer structure 1, but with an identical quantity of $AgNO_3$ of an emulsion according to example 5 in the 2nd layer.

Table 6 below shows the relevant sensitometric data for layer structures 1 and 2.

Table 7 shows the changes in the sensitometric data for the blue-sensitive layer after 6 months' storage at 20° C.

TABLE 6

| Layer structure | $D_{min}$ | lg I · t | G1 | G2 |
|---|---|---|---|---|
| 1 | 0.115 | 1.257 | 1.59 | 2.94 |
| 2 | 0.099 | 1.178 | 1.88 | 3.45 |

TABLE 7

| Layer structure | $\Delta D_{min}$ | Δlg I · t | ΔG1 | ΔG2 |
|---|---|---|---|---|
| 1 | 0.039 | 0.31 | −0.29 | −0.55 |
| 2 | 0.008 | 0.06 | −0.08 | −0.07 |

The following compounds were used as the color couplers:

Magenta coupler:

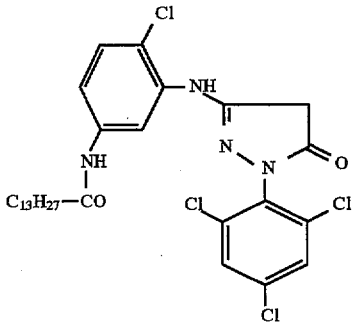

Cyan coupler

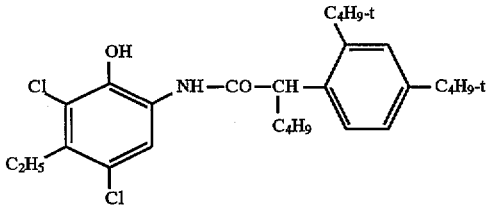

Tables 6 and 7 demonstrate that steeper gradation and reduced storage fog of the blue-sensitive layer are also achieved according to the invention in a complete layer structure.

We claim:

1. A color photographic material which comprises a support and at least one silver halide emulsion layer containing silver halide emulsion, wherein the silver halide emulsion is $AgCl_{0.15-0.999}Br_{0.85-0.001}$ emulsion is stabilised with the compounds I and II:

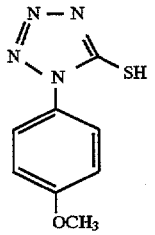

(I)

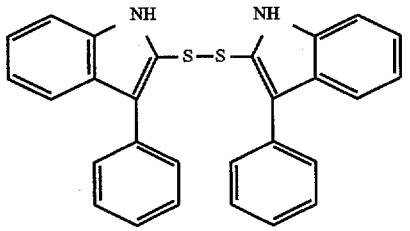

(II)

is ripened with a ripening agent containing gold and sulphur.

2. The color photographic silver halide material according to claim 1, wherein both compound I and compound II are used in a quantity of $10^{-7}$ to $10^{-3}$ mol/mol of silver halide.

3. The color photographic silver halide material according to claim 1, wherein the compound of the formula I is added after and the compound of the formula II before addition of the sulphur ripening agent.

4. The color photographic silver halide material according to claim 1, wherein the proportion of silver chloride in the emulsion is at least 80 mol. %.

5. The color photographic silver halide material according to claim 1, wherein the ripping agent contains $2.10^{-6}$ to $2.10^{-4}$ mol of gold compound/mol of Ag and $10^{-6}$ to $10^{-4}$ mol of sulphur compound/mol of Ag.

6. The color photographic silver halide material according to claim 1, wherein the silver halide emulsion layer contains a yellow coupler.

7. The color photographic silver halide material according to claim 4, wherein the proportion of silver chloride in the emulsion is above 95 mol. %.

8. The color photographic silver halide material according to claim 7, wherein the silver halide emulsion is doped with $10^{-9}$ to $10^{-4}$ mol of $Rh^{3+}$ ions and/or $10^{-9}$ to $10^{-4}$ mol of $Ir^{4+}$ ions per mol of silver halide.

* * * * *